United States Patent [19]

Josephs et al.

[11] Patent Number: 4,614,896

[45] Date of Patent: Sep. 30, 1986

[54] GETTER AND CONTACT ASSEMBLY FOR A CATHODE RAY TUBE

[75] Inventors: Mark A. Josephs, Seneca Falls; Roman Milikovsky, DeWitt; Carl W. Penird, Waterloo; Charles H. Rehkopf, Seneca Falls, all of N.Y.

[73] Assignee: North American Philips Consumer Electronics Corp., New York, N.Y.

[21] Appl. No.: 673,242

[22] Filed: Nov. 19, 1984

[51] Int. Cl.[4] ..... H01J 29/94

[52] U.S. Cl. ..... 313/481; 313/558

[58] Field of Search ..... 313/402, 407, 477 HC, 313/479, 481, 553, 558, 559, 404; 417/48, 51

[56] References Cited

U.S. PATENT DOCUMENTS 4,182,974 1/1980 Van Ijzeren ..... 313/482 X 4,230,966 10/1980 Compen ..... 313/481

*Primary Examiner*—Palmer C. DeMeo

*Assistant Examiner*—Sandra L. O'Shea

*Attorney, Agent, or Firm*—John C. Fox

[57] ABSTRACT

A color cathode ray tube incorporates a getter assembly and contactor structure that is introduced into the interior of the tube through the open neck subsequent to the sealing of the panel and funnel portions of the envelope, and a mounting bracket affixed to the internal magnetic shield of the tube for receiving and securely holding the getter assembly and contactor structure, enabling the use of non-bakable getter material in feedback-type tubes.

7 Claims, 4 Drawing Figures

GETTER AND CONTACT ASSEMBLY FOR A CATHODE RAY TUBE

BACKGROUND OF THE INVENTION

This invention relates to getter positioning in a color cathode ray tube (CCRT) having an internal magnetic shield, and more particularly relates to a getter and contact assembly and associated mounting means for attachment to the shield of such tube.

While the invention is useful in conventional CCRT's, it is particularly useful in high resolution CCRT's for displays having an automatic convergence system. Such displays have application in such demanding fields as computer aided design (CAD) and cartography. See ELECTRONIC PRODUCTS, May 12, 1983, p. 17. Essential to such an autoconvergence system are certain feedback features in the CCRT, which provide information on the location of the scanning electron beams to external correction circuitry, which then correct any misconvergence of the beams. Such feedback features include a phosphor pattern on the rear or gun side of the tube's aperture mask, and a window in the side of the tube. When impinged by the scanning electron beams, the rear-oriented phosphor pattern emits radiation, a portion of which is transmitted through the window and detected by an externally positioned photomultiplier tube.

The window must not only be transparent to the emitted radiation but also must be sufficiently conductive to prevent localized charge build-up, which could distort the adjacent potential field, resulting in disturbance of the trajectories of the electron beams. A suitable window structure is described and claimed in copending U.S. patent application Ser. No. 448,468, filed Dec. 10, 1982, assigned to the present assignee.

The getter flash, which is an internal deposit of gas-adsorbing material essential to adequate life of the CCRT, must be distributed in the feedback CCRT in a manner to avoid both the phosphor pattern on the back of the mask and the window, to assure an adequate signal to the photomultiplier tube. Such a distribution is achieved in a getter structure described and claimed in U.S. patent application Ser. No. 449,897, filed Dec. 15, 1982, assigned to the present assignee.

The feedback CCRT shares a common problem with other CCRT's, that is, susceptibility to high surge currents caused by internal arcing. Such susceptibility to arcing is not surprising in view of typical operating potentials as large as 25 to 30 kilovolts, and the large potential differences between various tube components, especially the closely spaced gun electrodes. Steps are taken during tube manufacture to minimize arcing during subsequent tube operation, especially high voltage conditioning in which a voltage of 40 kilovolts or more is applied between the terminal high voltage electrode and the adjacent electrode of the electron gun to remove projections and foreign matter from the inter-electrode spacing. Despite this and other precautions, occasional arcing does occur, resulting in momentary surge currents as high as 400 amps, which can be devastating to electrical components in the associated circuitry outside the CCRT. Thus, numerous structures have been proposed to reduce or dissipate surge currents inside the CCRT. These involve internal high resistance coatings in the neck and funnel regions of the tube, the positioning of resistive means between the internal conductive coating and the convergence cup, the placing of resistors between various gun components, and the discrete positioning of getters to avoid shorting of the internal coating by the getter or getter flash.

The effectiveness of high resistance coatings in the neck region may be reduced or eliminated by the getter assembly or getter flash or both forming a conductive bridge across the coating. Solutions offered to avoid this problem include moving the getter away from the neck region, for example, to the mask (U.S. Pat. No. 3,979,633). However, moving the getter to the mask results in getter flash deposits on the back side of the mask. This is, of course, undesirable in the feedback CCRT.

A solution to the problem is presented in U.S. patent application Ser. No. 525,758, filed Aug. 23, 1983, assigned to the present assignee, wherein a CCRT incorporates an arc suppression coating in the neck region of the tube, and a getter structure affixed to the internal magnetic shield (IMS). The getter structure is constructed and positioned to achieve a getter flash distribution that substantially avoids the mask and neck regions, as well as the window region of the feedback CCRT.

The getter structure has been affixed to the shield prior to sealing of the panel and funnel portions of the CCRT envelope, in the conventional manner. However, this procedure results in the getter being subjected to the elevated temperatures required for sealing, and getters which are known to withstand such sealing temperatures are not among the most efficient available. Therefore, to attain high quality tube performance and long tube life, the getter is desirably introduced to the tube subsequent to sealing. Techniques for achieving this are known in the art, by using an insertion tool to insert the getter through the open neck of the tube, and to mount the getter on the mask frame or anode button. Frame-mounted getters are not suitable for feedback CCRT's for the reason already mentioned, i.e., getter flash tends to deposit on the back side of the mask. Button-mounted getters require a specially designed anode button, and would not necessarily result in the required distribution of getter deposit for the feedback CCRT.

SUMMARY OF THE INVENTION

Accordingly, it is an object of this invention to provide a CCRT which incorporates a getter assembly which is introduced into the tube by insertion through the neck portion after sealing of the panel and funnel portions.

It is a further object of the invention to provide a getter and contact assembly for insertion through the neck portion, and an associated mounting means on the internal magnetic shield of the tube for receiving the getter and contact assembly.

It is a further object of the invention to provide a getter assembly on the internal magnetic shield of a feedback CCRT which provides a high quality getter deposit substantially in areas away from the mask, neck and window portions of the tube.

In accordance with the invention, an improved color cathode ray tube has an integrated getter assembly and contactor means, and an associated mounting bracket, the getter assembly and contactor comprising opposing first and second cantilever elements and an intermediate attachment means for attachment to the mounting bracket; the mounting bracket attached to the internal magnetic shield of the tube and having a leading edge formed to accept and hold the attachment means.

In accordance with a preferred embodiment of the invention, guide means are provided on the mounting bracket to limit transverse movement of the getter-contactor assembly on the bracket.

DETAILED DESCRIPTION

In accordance with the teachings of the invention, a mounting bracket is attached to the internal shield prior to the sealing of the panel and funnel portions. The getter assembly, which is inserted through the tube neck subsequent to the aforementioned sealing, has a clip-type attachment means that effects secure placement on the mounting bracket. The getter assembly, being thus positioned and affixed, achieves a getter flash distribution which substantially avoids the mask and neck regions of the tube, and the window region of a feedback CCRT.

Figure 1:
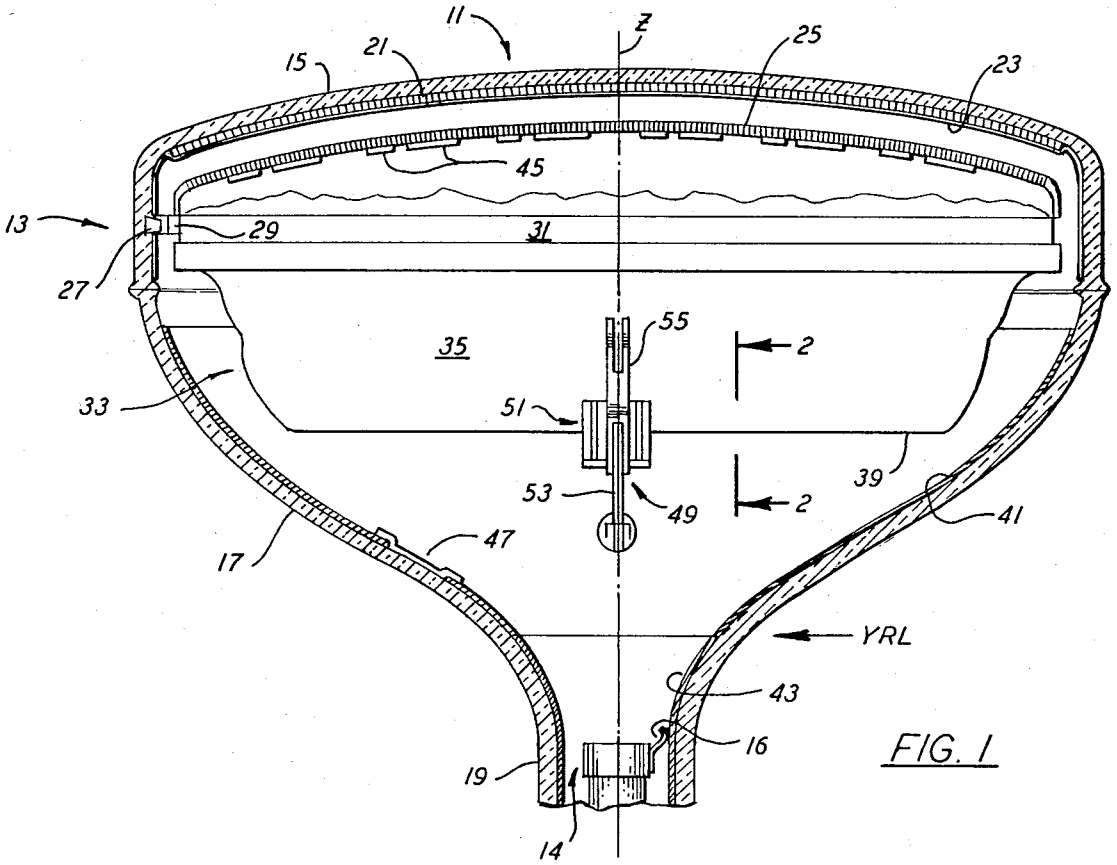
FIG. 1 is a cross-section of one embodiment of a color cathode ray tube wherein the invention is utilized.

The color cathode ray tube (CCRT) 11, shown in FIG. 1, is an exemplary feedback tube having a longitudinal Z axis and embodying an envelope 13 comprised of an integration of viewing panel 15, funnel 17, and neck 19 portions. Adhered to the inner surface of the viewing panel 15 is a patterned cathodoluminescent screen 21 formed of a multitude of discrete color-emitting phosphor elements. A thin metallized film 23, such as aluminum, is usually applied over the interior surface of the screen and a portion of the sidewall area of the panel. A multi-apertured structure or aperture mask member 25 is spatially related to the patterned screen 21, being positioned within the viewing panel 15 by a plurality of stud-like mask supporting members 27, partially embedded in the panel sidewall in spaced-apart orientation. Mating with these supporting studs are a like number of mask support means 29 which are suitably affixed to the frame portion 31 of the mask member 25. Mask member 25 directs the respective electron beams from the plural beam electron gun 14 to the desired phosphor elements on the screen 21.

Securely attached to the rear portion of the mask frame 31, as by a plurality of clips or welds, is an internal magnetic shield (IMS) 33 for shielding the beams from external stray magnetic fields. This structure, formed of a thin metal such as cold rolled steel, has a contoured bowl-like sidewall enclosure 35 having front and rear openings. The rear opening in the shielding member 33 is defined by a ledge 39 extending inward from the sidewall enclosure 35 toward the Z axis.

Conductive coating 41 disposed on the interior surface of the funnel 17 extends from the forward portion of the funnel to the yoke reference line (YRL), which line aids in the proper external placement of the magnetic deflection yoke, not shown. In this instance, a contiguous internal arc suppression coating 43 extends from the YRL into the neck portion 19 where it makes electrical contact with the electron gun assembly 14 by way of snubber 16. Coatings 41 and 43 can be abutting, as shown, or overlapping, to achieve the necessary electrical continuity between them. In the exemplary feedback tube being considered, a phosphor pattern on the back of mask member 25, denoted by elements 45, emits radiation toward the rear of the tube upon being impinged by electron beams emanating from gun assembly 14. Window 47 in coating 41 passes some portion of the radiation to an externally placed detector such as a photomultiplier tube, not shown.

Figure 2:
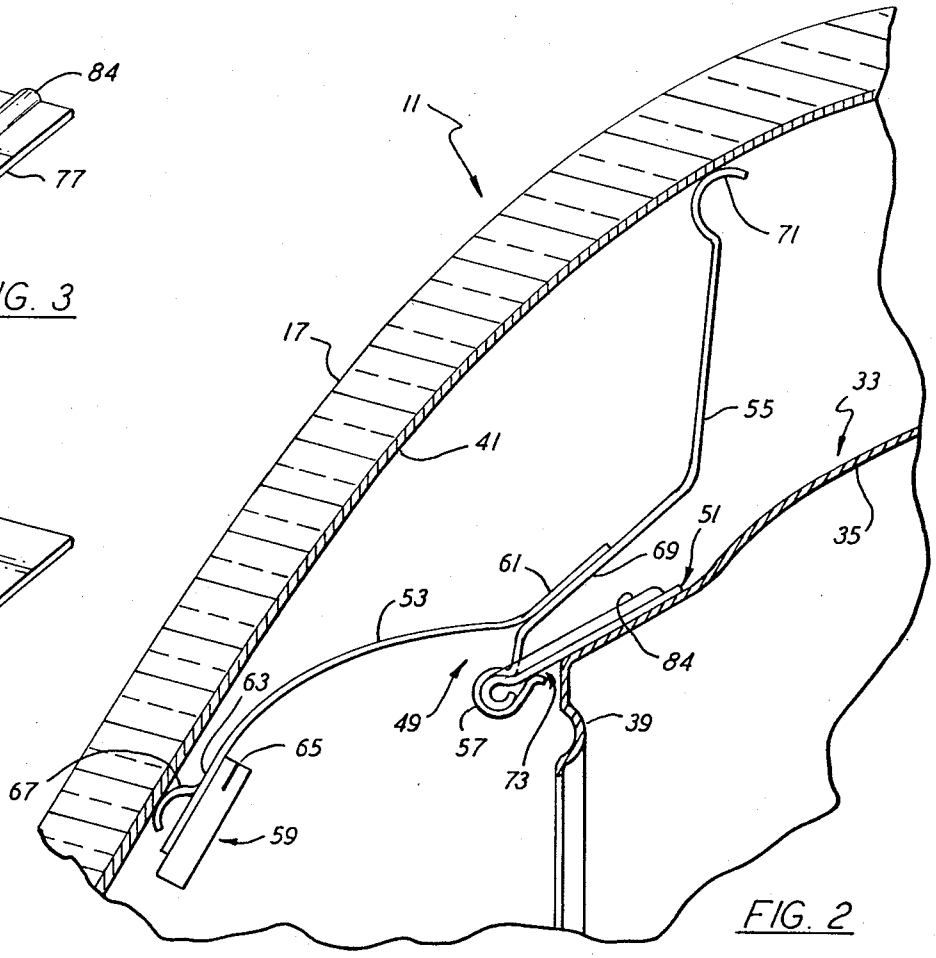
FIG. 2 is an enlarged portion of the tube of FIG. 1, taken along section 2—2, detailing a portion of the getter and contact assembly and mounting means of the invention.

The invention, as illustrated in FIGS. 1 and 2, comprises a clip-on getter assembly and contactor means 49 and associated mounting bracket 51 which are securely affixed to the rear portion of the magnetic shielding member (IMS) 33. The mounting bracket 51 is firmly attached, such as by welding, to the shielding member prior to frit sealing of the mask-shield-face panel assembly to the funnel. After this sealing operation is accomplished, the getter and contactor assembly 49 is inserted into the funnel, through the open neck thereof by a special tool, not herein disclosed, and clipped to the affixed mounting bracket 51. By introducing the getter in this manner, a reliable and conventional non-bakeable getter may be readily employed.

In greater detail, the getter assembly and contactor means 49 is a structure which exhibits flexibility and is thus easily inserted through the neck portion 19. The structure 49 is a composite structure comprised of opposed first and second resilient cantilever elements 53 and 55, extending longitudinally in either direction from intermediate clip-type attachment means 57. The first cantilever element 53 is the wand portion of the getter assembly, and has an apertured getter container 59 terminally attached thereto for orientation toward the neck portion 19 of the tube. The container 59 accommodates a getter material to be flashed during tube manufacture. Getter materials and flash techniques are well known in the art. Getter materials are primarily barium compounds and are conventionally flashed by placing an RF heating coil near the outside wall of the funnel adjacent the getter container after the tube has been exhausted and sealed, whereupon heat from the activated coil vaporizes the getter material.

Referring now to FIG. 2 in particular, there is shown an enlarged sectional view taken along section 2—2 of a portion of the tube 11 of FIG. 1, presenting a side view of the structure 49. The first cantilever element or wand 53 is made of a metallic spring material, such as stainless steel. Its basal end 61 is affixed to a metallic clip 57. The getter container 59, positioned on the terminal end 63 of wand 53, is in this instance a closed cup-shaped formation having a slot-shaped aperture 65 disposed in the wall thereof facing the first cantilever element 53. By having the slot so oriented, the vaporized getter material is directed up between the funnel 17 and IMS 33, and away from the neck portion 19. The spring bias of the first cantilever element 53 insures firm electrical contact between the getter container 59, via skids 67, and the internal coating 41. In addition to providing contact, the skids 67 allow the getter assembly to slide along coatings 41 and 43 during insertion of the structure 49 into the funnel portion 17.

The opposed second cantilever 55 is a resilient arm-like contact or member formed of metallic material and having a basal end 69 attached to the clip 57. In this instance, the clip 57 is an integral continuation of the second cantilever element 55. As shown, the basal ends 61 and 69 of the first and second cantilever elements 53 and 55 are affixed in substantially superjacent relationship. The spring bias of the second cantilever element or contactor 55 insures firm electrical contact, via at least one finger 71, with internal coating 41. In addition, finger 71 provides a second sliding contact along coatings 41 and 43 to provide additional stability for structure 49 during insertion.

The intermediate clip-type attachment means 57 is formed of spring material to have a resilient mouth 73 facing in the direction of the second cantilever element 55.

The associated mounting bracket 51, for receiving and holding the getter assembly and contactor structure 49, is comprised of a base member 75, a clip-receiving portion 81, and guide means 83 and 84.

A forward portion 77 of the base member 75 is securely affixed, as by welding, to a rear area of the wall 35 of the IMS 33. The rearward portion 79 of the bracket, having the clip-receiving portion 81, extends beyond the wall to face the neck region 19 of the tube. As shown, the clip-receiving portion 81 is a rolled edge of the base 75, transverse to guide means 83 and 84 and dimensioned to fit into the resilient mouth 73 of clip 57, the spring bias of which causes clip 57 to firmly encompass the rolled edge 81.

Figure 3:
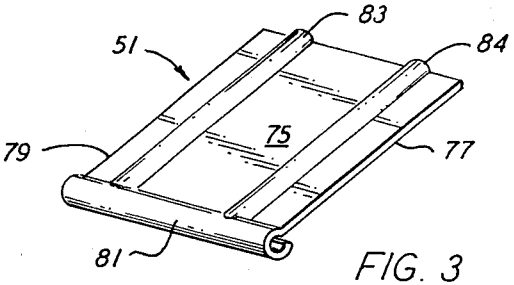
FIGS. 3 and 4 are perspective views illustrating two embodiments of the mounting means of the invention.

To insure proper placement of the clip 57 on the mounting bracket 51, at least one pair of guide means 83 and 84 is formed on the bracket base member 75. In the embodiment of FIGS. 2 and 3, these guide means are two spaced apart longitudinal raised ribs formed in the base member transverse to the edge-rolled formation 81. These ribs tend to limit transverse shifting of the clip 57 on the bracket 51.

Figure 4:
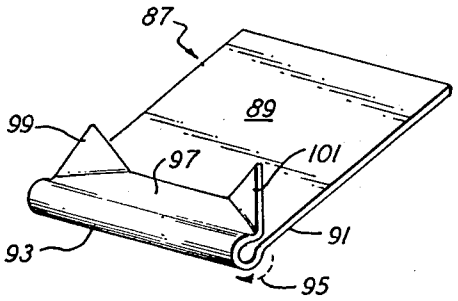

The second exemplary embodiment of the mounting bracket 87 is shown in FIG. 4. In this construction, the base member 89 also has a rearward region 91 that is formed as a rolled edge 93 to fit clip 57. This formation embodies a clockwise roll as noted by arrow 95. Additional material 97 at the end of the rolled formation 93 is bent flat to the plane of the base member 89. Opposed edge regions 99 and 101 of the flattened material 97 are bent upward to form two spaced apart projections which function as guide means for clip 57.

During insertion of the getter and contactor assembly 49 into the neck of the tube, and up the sidewall of the funnel to engage the bracket 51, the first and second cantilever elements 53 and 55 provide two-point stabilization of the assembly at the getter skid means 67 and at the contact fingers 71, in addition to providing a plurality of electrical contact areas between the IMS 33 and the funnel coating 41.

While there has been shown and described what are at present considered the preferred embodiments of the invention, it will be obvious to those skilled in the art that various changes and modifications may be made therein without departing from the scope of the invention as defined by the appended claims.

For example, the described getter assembly and contactor means with associated mounting means, while especially useful in CCRT's having feedback features, may also benefit conventional CCRT's without such feedback features.

What is claimed is:

1. An improvement in a color cathode ray tube having a glass envelope of integrated neck, funnel and face panel portions, a plural beam electron gun in the neck portion, a phosphor screen having a plurality of phosphor elements on the interior surface of the face panel portion, an aperture mask adjacent the screen for directing the electron beams to the desired phosphor elements, an internal magnetic shield attached to the aperture mask for shielding the beams from external stray magnetic fields, and a conductive coating disposed on the interior surface of the glass envelope to provide electrical connection between the terminal portion of the gun and the mask, said improvement being an integrated getter assembly and contactor means and an associated mounting bracket, characterized in that:

(a) the getter assembly and contactor means comprises intermediate attachment means, opposed first and second resilient cantilever elements extending longitudinally from the intermediate attachment means; said first cantilever element being the wand portion of the getter assembly and oriented toward the neck portion of said tube; and having an apertured getter container attached to the terminal portion of the wand for making sliding contact with said conductive coating; said opposed second cantilever element being a resilient arm-like electrical contactor, oriented toward the panel portion of said tube; and having a terminal portion for making sliding contact with said conductive coating; said getter assembly and contactor means being a structure suitable for insertion through said neck portion into the interior of said tube after sealing of the panel and funnel portions; and (b) the associated mounting bracket for said structure comprises a base member affixed to said internal magnetic shield and having an edge oriented toward the neck portion of said tube and formed to receive and hold said attachment means upon introduction of the getter assembly and contactor means through the open neck into the sealed envelope of the tube.

2. The improvement in a color cathode ray tube according to claim 1 wherein said getter container has at least one skid thereon oriented in a manner to make contact with said funnel coating and slide therealong during structure insertion into the envelope.

3. The improvement in a color cathode ray tube according to claim 1 wherein the intermediate attachment means of said getter assembly and contactor means is a clip having a resilient mouth oriented toward the face panel portion of the tube.

4. The improvement in a color cathode ray tube according to claim 3 wherein the formed edge of said mounting bracket for receiving said attachment means is rounded and dimensioned for compatible clip acceptance.

5. The improvement in a color cathode ray tube according to claim 4 wherein the mounting bracket has at least one pair of guide means to limit the transverse shifting of said clip-type attachment means thereon.

6. The improvement in a color cathode ray tube according to claim 5 wherein said guide means are spaced apart longitudinally oriented raised ribs in said base member.

7. The improvement in a color cathode ray tube according to claim 5 wherein said guide means are spaced apart upward projections of said base member.

* * * * *